United States Patent [19]

Matalon

[11] Patent Number: 4,985,041

[45] Date of Patent: Jan. 15, 1991

[54] DYE ASSISTANT COMPOSITION FOR HYDROPHOBIC FIBERS

[76] Inventor: Ralph Matalon, 1528 Burnt Mill Rd., Cherry Hill, N.J. 08003

[21] Appl. No.: 123,383

[22] Filed: Nov. 20, 1987

Related U.S. Application Data

[63] Continuation-in-part of Ser. No. 930,690, Nov. 10, 1986, which is a continuation of Ser. No. 792,224, Oct. 25, 1985, abandoned, which is a continuation-in-part of Ser. No. 581,314, Feb. 17, 1984, abandoned.

[51] Int. Cl.[5] ..... C08K 5/05; D06P 5/22

[52] U.S. Cl. ..... 8/130.1; 8/532; 8/583; 8/588; 8/589; 8/591; 8/611; 8/614; 8/617; 8/922

[58] Field of Search ..... 8/130.1, 550, 616

[56] References Cited

U.S. PATENT DOCUMENTS 3,561,915 2/1971 Matalon ..... 8/495

*Primary Examiner*—A. Lionel Clingman

*Attorney, Agent, or Firm*—Armstrong, Nikaido, Marmelstein, Kubovcik & Murray

[57] ABSTRACT

Compositions for use as dye assistants are formed from a non-phenolic aromatic swelling agent for the fiber to be dyed mixed with just enough dispersant to cause a non-foaming emulsion upon dilution of the dye assistant in water, but not enough dispersant to interfere with the swelling process of the fiber by the dye assistant. Thus, the swelling agent is mixed with the minimum amount of surfactant required for the production of an emulsion and dispersion of the dye with little or no foaming in the dye bath. Formulations can also be prepared having higher levels of water which are non-flammable.

5 Claims, No Drawings

DYE ASSISTANT COMPOSITION FOR HYDROPHOBIC FIBERS

This is a continuation-in-part of my copending application Ser. No. 930,690, filed Nov. 10, 1986 which is a continuation of Ser. No. 792,224, filed Oct. 25, 1985 and now abandoned. Ser. No. 792,224 is a continuation-in-part of my prior application Ser. No. 581,314, filed Feb. 17, 1984 and now abandoned.

BACKGROUND OF THE INVENTION

The present invention relates to the dyeing of hydrophobic fibers, particularly polyesters, and more especially to a liquid dye assistant composition adapted for use in the level dyeing of such fibers even at a temperature below the boiling point of the dye bath.

The dyeing of hydrophobic fibers such as polyesters has presented a considerable problem in the textile dye industry because their hydrophobic nature renders them innately unreceptive to dyes. In order to increase the receptivity of hydrophobic fibers to dyes, the textile dye industry has heretofore treated such fibers with a variety of textile dye assistants which are incorporated either in the dye bath itself or in a bath preceding the dye bath.

The textile assistant of the present invention is particularly advantageous because it enables one to use dyes having a high diffusion temperature with hydrophobic fibers such as polyester, achieving substantially complete exhaustion of the dye and dye assistant from the dye bath. Such complete exhaustion is desirable in view of the current industrial concern, particularly within the dyeing industry, about discharging potential pollutants into the atmosphere or ground waters. The present invention also is advantageous because the dye baths which it provides are relatively nonfoaming, which is of importance in the economical application of the process of the present invention in industry.

The dyeings achieved by the present invention show a particular advantage when treating fabrics of mixed fiber content, for example polyester and cotton. The application of dyes in the high diffusion temperature from plain water, i.e., in the absence of the usual dye assistants, produces very poor results even at temperatures of 230° to 240° F. To utilize such dyes effectively it is common to employ temperatures of 265° F. or above to obtain an adequate yield of color on the polyester. Under these conditions adjoining fibers such as cotton may be heavily stained. The dye assistants of the present invention permit dyes of such high diffusion temperature to be employed at temperatures below the boiling point of the dye bath at atmospheric pressure, as well as up to the higher temperatures at which such dyes are traditionally used, and achieve deep level dyeing of the polyester without undesired staining of adjoining fiber, such as cotton, wool or acrylic. This means that good contrast can be obtained without the necessity of special scouring.

Dye-stuffs of high diffusion temperature are capable of yielding dyed polyester having good light-fastness. However, certain dye assistants affect fastness adversely, notably those containing phenolic swelling agents. Moreover, many times a dyer may wish to apply several different types of dyes, one of which is a high temperature dye and another of which is a dye which is unstable at temperatures of 265° F. (e.g. many basic dyes). Heretofore such a dyeing has required two steps—one at a high temperature for application of the high temperature dye, and a second at a lower temperature at which the low temperature dye is stable. This not only complicates the process, but also may reduce the quality of the product, since even those fibers which will tolerate dyeing at a temperature of 265° F. will tend to be degraded and feel harsh when treated at such high temperatures. Furthermore, the use of high dyeing temperatures increases the odor level in the dyeing plant and the exhaust vapors.

Heretofore it has been attempted to dye polyesters at atmospheric conditions using dye assistants such as methylnaphthalene or trichlorobenzene. These have met with objection because of the pollution caused by such dye assistants, i.e., bad odor from the methylnaphthalene and poor bidodegradability of trichlorobenzene. The application of the still more expensive butylbenzoate has not produced good dye yield with many dye stuffs. Still another swelling agent which has been used is orthophenylphenol, which however is limited because of its high price, lack of availability, and deleterious effect on the light-fastness, particularly with azo dyes, and pollution of water due to its high toxicity towards bacterial and aquatic life. For these reasons dyeing under high pressure has continued to expand, while at the same time there is still a need for satisfactory methods of dyeing polyesters at temperatures in the range of 200° to 240° F. not requiring high pressure equipment, and which are relatively non-polluting, economical and produce high yields of fast colors with dyes having low diffusion rates.

My prior U.S. Pat. No. 3,561,915 disclosed textile assistant compositions intended to permit low temperature dyeing of textiles using a textile dye assistant containing polar dispersant, a non-polar dispersant and an aromatic non-polar swelling agent for hydrophobic fibers. While the dye assistant disclosed in my prior patent provided improvements in permitting low temperature dyeing of polyester fabrics, experience has shown that the previously known compositions were not highly effective in promoting the level dyeing of deep shades employing dye stuffs which would not diffuse into the fiber except at an elevated temperature.

These shortcomings of the dye stuffs and assistants heretofore available can be largely overcome with the new dye assistant which has been discovered, which will be described more fully below. Using the new dye assistant, dyeing of ordinary polyesters may be carried out at a temperature as low as 180° to 190° F., and the rate of dyeing will rise considerably as the temperature reaches 190° to 210° F., the rate of dyeing will further increase, which reduces the time required for the dyeing cycle and enhances penetration of the dye into the fiber at such higher temperature. (The maximum permissible temperature depends on the fiber used).

Of equal importance is dye utilization efficiency of the so-called high temperature dyes. Surprisingly, I have found that with the present invention the utilization efficiency of such dyes at 200°-240° F. is comparable to at or even greater than the efficiency which could formerly be realized only at temperatures of 265° F. Moreover, the present invention is advantageous in providing high dyeing efficiency and dyed fabrics of improved light-fastness.

The new dyeing assistant providing these desirable results uses primarily low or moderately priced chemicals, is economical in use, and will produce a high yield of color on polyester with the slow diffusing dyes. Such results are obtained even at the dye assistant levels as little as 3% to 7% on the basis of the weight the of polyester-cotton blends. At higher temperatures less may be needed. Moreover, the odor in dyeing using the present invention is much reduced in the plant and exhaust vapors. Furthermore, noticeable and unexpected improvements in dye utilization, dye bath exhaustion and dyeing speed can be realized. The by-products released from the dyeing operations are essentially bidodegradable and, because of the substantially complete exhaustion of the dye bath, are materially less toxic to the environment than the dye assistants heretofore used.

SUMMARY OF THE INVENTION

The compositions of the present invention are formed from a non-phenolic aromatic swelling agent for the fiber to be dyed mixed with just enough dispersant to cause a non-foaming emulsion upon dilution of the dye assistant in water, but not enough dispersant to interfere with the swelling process of the fiber by the dye assistant. Thus, the swelling agent is mixed with the minimum amount of surfactant required for the production of an emulsion and dispersion of the dye with little or no foaming in the dye bath. In determining the amount of dispersant which is employed consideration must be given not only to the presence of the anionic and nonionic detergents and soaps which are present, but also to the amounts of alcohol (of varying degrees of solubility in water) which effect the degree of dispersion of the dye assistant, as well as to the dye and to certain secondary agents, for example esters, of measurable water solubility which may be present for other purposes but which also can affect the water dispersibility of the dye assistant.

While disclosed for use primarily as a dye assistant, it should be recognized that the compositions of the present invention may also be used as all or part of a scouring formulation if desired. The dye assistants of the present invention can also be used in printing or steaming operations.

The dye assistants of the present invention can be added to the dye bath either before or after adding the dye, in accordance with the usual practice, or can be combined with the dye before either is added to the dye bath.

In accordance with the present invention a typical dye assistant will contain (A) a non-phenolic aromatic swelling agent; and (B) a dispersant system in an amount sufficient to give a hydrophilic/hydrophobic balance to the dye assistant composition such that mixtures of the dye assistant with water having compositions outside of a relatively narrow "range of clarity" will be cloudy. By dispersant I am referring to the mixture of alcohols and surfactants which are added to control the hydrophilic/hydrophobic balance of the dye assistant composition, which in turn affects the spreading of the swelling agent in the fiber substrate. Typically, the non-phenolic swelling agent (A) will be between 72% and 97.5% by weight of the mixture, and the dispersant (B) will be between 2.5% and 28% and present in an amount sufficient to form an emulsion of the swelling agent and disperse the dye when employed at use dilutions in a dye bath. The dye assistant composition may also include esters or other materials.

DETAILED DESCRIPTION OF THE INVENTION

In contrast to the previously disclosed system in U.S. Pat. No. 3,561,915 which was both esterophilic and hydrophilic, the compositions of the present invention are much more limited in their hydrophilic characteristics. Instead of showing the wide range of clarity previously observed on mixing with water, e.g. 50%–200%, the new systems show a narrow range of clarity. Thus, when a small amount of water is added, the mixture will usually be cloudy; as the amount of water is increased the mixture will turn clear and with still more added water it will turn cloudy again. In some cases, the mixture will remain clear upon the initial addition of water, but will become cloudy upon subsequent additions. The magnitude of the "range of clarity" can be expressed numerically as a percentage, based upon the total volume of water which can be added before the onset of cloudiness subsequent to the onset of clarity. Compositions in accordance with the claimed invention exhibit a range of clarity on the order of 35% or less, i.e. not more than about 3.5 ml of water can be added before the onset of cloudiness following a clear composition. In some cases complete clarity will not be observed, but the mixture will change from distinctly milky to translucent and then revert to a milky appearance as water is added. The range of clarity gradually decreases as the surfactant content of a system is reduced. Preferably the onset of clarity upon mixture with water occurs when between 0.3 ml and 1.7 ml water have been added.

This test of the limited hydrophilic character of the dye assistant of the present invention emphasizes its uniqueness. The previously formulated dye assistants are readily dispersible in water, which is a result of such materials being hydrophilic. This hydrophilicity is a consequence of the weight ratio of swelling agent to non-polar dispersant which is from 1.2 to 2.5, limiting the swelling agent concentration to less than 71%. However the character of such dye assistants limits their capacity to facilitate the uptake of dyes on oleophilic fiber such as polyesters, etc. The dye assistants of the present invention are oleophilic. While this means that they are better suited to promoting uptake of dye by oleophilic fibers, it makes it difficult to disperse the dye assistants of the present invention in the usual aqueous dye bath. If merely added to the dye bath, typically in proportions of under 1% (i.e., over 100 parts of water per part of assistant), a poor emulsion will result. In using dye assistants of the present invention, attention must also therefore be given to its dilutability (or lack of dilutability) in water when using it. If the range of clarity indicated by the above test occurs at a relatively large amount of water (i.e., in the range of 1.2–3.5 ml, the composition of the present invention is usually dilutable after it has been pre-dispersed in enough water to fall within the zone of clarity. The compositions which show a range of clarity at low levels of water addition (i.e., between 0.3 and 1.2 ml of water) usually will require dilution in two stages: first mixture with water to within the range of clarity; and second addition of enough additional water (typically to a mixture containing 15–125 parts of water per 100 parts of assistant) to form a dilutable mixture.

At very low surfactant levels (for example, 2% to 3% by weight of the composition), the alcohols play an important role in the emulsification of the swelling agent. The range of clarity is influenced as well by ester swelling agents of measurable water-solubility which may be present. Typical ester swelling agents are referred to below. Typically such esters if present will be 0.5% to 18% by wt. of the swelling agent when the swelling agent is primarily mononuclear and the swelling agent to dispersant ratio can be increased to as much as 20:1.

In some of the new assistant compositions illustrated in Example 1 the amount of surfactant relative to the amount of mononuclear swelling agent is reduced below 10%. Increased color yield has been observed with such compositions as the surfactant is further reduced to about 2% to 3%. The reduction of the surfactant is possible because of the presence of alcohols and of esters. This reduction of surfactant is of great significance in reducing the foaming and the solvation properties of the assistant in the dye bath. This permits the dyeing to be conducted to substantial exhaustion, leaving a waste water from the process containing a minimal amount of contaminants. Generally the swelling agent to dispersant ratio will be between 2.4:1 and 20:1. A typical assistant will contain as a dispersant system, for example:

(1) a monohydric alcohol having a water solubility between 0.05% and 4% by weight, (2) a monohydric alcohol having water solubility between 4% and 16%, the ratio of swelling agent to the total amount of alcohols present being between about 3.4:1 and 8:1 and (3) surfactants such as a heat and acid stable anionic synthetic organic surfactants, heat and acid unstable fatty acid soaps, and the common nonionic surface active agents in an amount, depending on the alcohols and other components present, sufficient to emulsify the system without exceeding the desired range of clarity.

Swelling agents which may be used in accordance with the present invention are the common mononuclear, non-phenolic swelling agents containing from 6 to 12 carbon atoms such as toluene, xylene, trichlorobenzene, orthochlorotoluene and parachlorotoluene, Ester swelling agents having a water solubility of less than 1.5% such as methyl salicylate, benzyl benzoate, phenyl benzoate, butyl benzoate, methyl benzoate, ethyl benzoate, and diethyl phthalate are optionally incorporated in the composition to enhance the dispersibility as well as for their activity as swelling agents.

The preferred swelling agents are the biodegradable mononuclear aromatics such as xylene, orthochlorotoluene and parachlorotoluene. Chlorinated benzenes such as monochloro, dichloro and trichloro benzene are less preferred because they are not readily bidodegradable.

Ester swelling agents such as methyl benzoate, dimethyl phthalate and diethyl phthalate are very desirable because of their low cost and acceptable ecological properties. These esters are also valuable in aiding the preparation of dye assistant formulations by imparting improved emulsification properties even at low surfactant levels and a high affinity for the polyester fiber ensuring better dye stuff utilization and greater dye bath exhaustion. This result is attributable to the hydrophilic characteristics of the ester which ensures satisfactory emulsification even when the surfactant and the alcohol content is reduced.

Thus the use of esters provides a valuable tool in aiding preparation of the dye assistant formulations of low alcohol and surfactant content but rich in mononuclear aromatic swelling agents having improved dye performance. The reduction in the amount of mononuclear swelling agents such as xylene (or even chlorinated aromatic compounds if they should be used) increases the stability of the dye bath against loss of swelling agent by volatilization at the dye bath temperature with a consequent improvement in dye yield and leveling of the polyester fiber and reducing staining of adjoining fiber.

As noted above, the dispersant system used in the present invention contains surfactants and alcohols. Typical examples of the surface active agents for example are described in the book by Schwartz and Perry entitled "Surface Active Agents", and include the linear biodegradable alkyl or alkylaryl sulfonic acids and sulfuric acids, having alkyl groups of from 6 to 24 carbon atoms, an aryl group which is benzene or a naphthalene, and include the water soluble alkali metal salts and ammonia salts of such compounds. Representative examples include sodium lauryl sulfate, linear dodecyl benzene sulfonic acid, the sodium salt of linear pentadecyl benzene sulfonic acid and the like. Nonionic surfactants such as the ethylene oxide condensates of long chain alcohols typically containing 10–16 carbon atoms or such condensates with alkyl phenols such as octyl phenol, and block polymers of ethylene oxide and propylene oxide.

The heat and acid unstable fatty acid soaps which can be employed include the ammonium, monoethanolamine, diethanolamine, triethanolamine and isopropanolamine salts of caprylic acid, capric acid, myristic acid, stearic acid, oleic acid and ricinoleic acid as well as the salts of such naturally occurring mixtures of fatty acids as are found in oils and fats. It is preferred that the fatty acid salt be formed in situ in the composition by a reaction between the fatty acid and the ammonia and/or amine.

Examples of monohydric alcohols of low solubility (0.5% to 4% in water) and high solubility (4% to 16% in water) have been described in my prior patent, U.S. Pat. No. 3,561,915. Representative examples include monohydric alcohols having a solubility in water from about 0.5% to about 4% by weight, such as cyclohexanol, methylcyclohexanol, benzyl alcohol, pentan-1-ol, 3-methyl-butan-1-ol, and the like. Typical monohydric alcohols having a solubility of 4% to 16% by weight which can be used include n-butyl alcohol, isobutyl alcohol, etc.

In a number of the examples which follow illustrating compositions according to the invention, the ratio of low solubility alcohols to high solubility alcohols, for example the cyclohexanol/butyl alcohol ratio, is around 3. In other examples, it is indicated to be around 1.5. In still other systems good results are obtained when the butyl alcohol has become the major component in the cyclohexanol/butyl alcohol system. It is to be noted that this ratio is related to the amount of surfactant which is present in the dye assistant composition. Generally where there is more of the low solubility alcohol (i.e. a relatively high cyclohexanol/butyl alcohol ratio) a greater amount of surfactant is required to obtain dispersibility of the dye assistant in the dye bath, and the greater amounts of both the cyclohexanol and the surfactant reduce the concentration of the swelling agent which can be employed. On the other hand using a relatively low cyclohexanol/butyl alcohol ratio reduces the need for the surfactant and permits relatively high concentrations of swelling agent to be employed. In one example, for instance, at a low ratio of cyclohexanol to butyl alcohol the dye assistant composition contained 97% of the swelling agent (chlorotoluene) and less than 4% of a combination of surfactants and alcohols. The use of such high hydrophobic systems have heretofore been thought to be impossible in the dye assistant art.

The textile dye assistant composition of the present invention can be readily prepared by merely blending the components thereof together at room temperature or higher if desired. Neutralization is preferably the last step so as to avoid intermediate gelation due to soap formation.

It is further to be noted that in some formulations exemplified below esters swelling agents such as methyl benzoate and dimethyl phthalate are used in the composition in combination with the non-phenolic swelling agent. These formulations demonstrate the ability of such esters to affect the hydrophilic/hydrophobic balance of the composition because of their water solubility, and thus to function as a part of the dispersant, system. As a result, the amount of alcohols incorporated can be reduced. When an ester used as part of the dispersant, the composition of the present invention may contain very large amounts of the non-phenolic mononuclear swelling agent. Such composition may be from 85% to 95% mononuclear swelling agent, have a ratio of non-phenolic mononuclear swelling agent to dispersant (excluding ester swelling agent) of between 10:1 and 50:1 and contain a sufficient amount of ester swelling agents so that the composition will have a zone of clarity within the range specified above. The inclusion of ester swelling agents is optional, and can affect the hydrophilic/hydrophobic balance as explained above.

The preferred dye assistants according to the invention are biodegradable and of limited hydrophilic properties, as demonstrated by a range of clarity of 35% or less. In addition, non-flammable formulations can be prepared, even though they incorporate significant amounts of materials such as xylene or chlorotoluene. This is achieved by preparing the dye assistant as a water-diluted substantially single-phase composition containing from about 10 to 25% water intimately associated with the otherwise flammable material.

The following are examples of dye assistants within the scope of the present invention:

EXAMPLES 1-3

Three formulations of dye assistant were prepared by mixing the swelling agent with the previously compounded dispersant at room temperature to give the compositions shown in Table I.

Titration of 10 grams of each of these three examples with water resulted in a range of clarity of 6 to 14%.

TABLE I

| | 1 | 2 | 3 |
|---|---|---|---|
| Non-Phenolic Mononuclear Swelling Agent | | | |
| Chlorotoluene | 93.4 | | |
| Xylene | | 93.4 | |
| Trichlorobenzene | | | 93.4 |
| Dispersant | | | |
| Cyclohexanol | 1.6 | 1.6 | 1.6 |
| Butyl Alcohol | 1.7 | 1.7 | 1.7 |
| Dodecylbenzene Sulfonic Acid | 2.4 | 2.4 | 2.4 |
| Oleic Acid | 0.3 | 0.3 | 0.3 |
| Monoethanolamine | 0.3 | 0.3 | 0.3 |
| Nonylphenol 5EO Condensate | 0.3 | 0.3 | 0.3 |

TABLE I-continued

| | 1 | 2 | 3 |
|---|---|---|---|
| Titration of 10 gr. Product with water. | | | |
| Range of clarity (%) | 14 | 8-12 | 6 |

The above assistants do not disperse in water in their concentrated state, probably because of the low level of dispersant.

EXAMPLES 4-6

Three additional formulations were prepared in accordance with Examples 1-3 having the compositions shown in Table II.

TABLE II

| | 4 | 5 | 6 |
|---|---|---|---|
| Mononuclear Swelling Agent | | | |
| Chlorotoluene | 76 | | |
| Xylene | | 76 | |
| Trichlorobenzene | | | 76 |
| Dispersant | | | |
| Cyclohexanol | 11.6 | 11.6 | 11.6 |
| Butyl Alcohol | 5.6 | 5.6 | 5.6 |
| Dodecylbenzene Sulfonic Acid | 3.2 | 3.2 | 3.2 |
| Oleic Acid | 1.2 | 1.2 | 1.2 |
| Monoethanolamine | 1.2 | 1.2 | 1.2 |
| Nonylphenol 5EO Condensate | 1.2 | 1.2 | 1.2 |
| Titration of 10 gr. Product with water. | | | |
| Range of clarity (%) | 29 | 20 | 24 |

The above assistants have a higher level of dispersant and show partial dispersion in water in their concentrated state. Disperson is excellent at the clearing point, or at the Tyndal clearing point.

EXAMPLES 7-9

Three further formulations were prepared as shown in Table III having still higher levels of dispersant.

TABLE III

| | 7 | 8 | 9 |
|---|---|---|---|
| Mononuclear: | | | |
| Chlorotoluene | 70 | | |
| Xylene | | 70 | |
| Trichlorobenzene | | | 70 |
| Dispersant | | | |
| Cyclohexanol | 15.6 | 15.6 | 15.6 |
| Butyl Alcohol | 7.8 | 7.8 | 7.8 |
| Dodecylbenzene Sulfonic Acid | 3 | 3 | 3 |
| Oleic Acid | 1.2 | 1.2 | 1.2 |
| Monoethanolamine | 1.2 | 1.2 | 1.2 |
| Nonylphenol 5EO Condensate | 1.2 | 1.2 | 1.2 |
| Titration of 10 gr. Product with water. | | | |
| Range of clarity | 37-40 | 27 | 28 |

The above assistants show partial dispersion in water in their concentrated state.

The results obtained in Examples 2, 5 and 8 can be substantially duplicated with respect to range of clarity when aklylated xylenes such as Exxon's AROMATIC 100 and AROMATIC 150 are used in place of xylene. Similar tests conducted with AROMATIC 200, a more hydrophobic alkylated xylene, had a lower range of clarity.

EXAMPLES 10–17

Formulations incorporating an ester swelling agent in the dispersant were prepared as shown in Table IV. The formulations of Examples 10–13 had good dispersion characteristics, despite the high levels of mononuclear swelling agents incorporated.

TABLE IV

| Example | 10 | 11 | 12 | 13 | 14 | 15 | 16 | 17 |
|---|---|---|---|---|---|---|---|---|
| Dispersant | | | | | | | | |
| Cyclohexanol | 2 | 1.6 | 1.7 | 0.95 | 1.08 | 0.2 | 0.175 | 0.125 |
| Butyl Alcohol | 1.4 | 1.8 | 1.7 | 1.8 | 2.06 | 0.44 | 0.415 | 0.365 |
| Dodecylbenzene Sulfonic Acid | 2.2 | 1.9 | 2.1 | 1.55 | 1.3 | 1 | 0.95 | 0.85 |
| Oleic Acid | 0.37 | 0.43 | 0.4 | 0.25 | 0.2 | 0.1 | 0.095 | 0.085 |
| Monoethanolamine | 0.37 | 0.43 | 0.4 | 0.25 | 0.2 | 0.1 | 0.095 | 0.085 |
| Nonylphenol 5EO Condensate | 0.37 | 0.43 | 0.4 | 0.25 | 0.2 | 0.1 | 0.095 | 0.085 |
| Methyl Benzoate | 2.6 | 2.6 | 4.2 | 2.05 | — | 0.4 | 0.4575 | 0.575 |
| Dimethyl phthalate | 2 | 2 | 3.3 | 1.52 | — | 0.2 | 0.1575 | 0.365 |
| Mononuclear Swelling Agent: | | | | | | | | |
| Chlorotoluene | 89 | 89 | 85.8 | 90.2 | 95 | 97.46 | 97.46 | 97.482 |
| Range of Clarity (%) | 11 | 11 | 11 | 9 | 6 | 2 | 2 | 2 |

EXAMPLES 18–21

Examples 18–21 show further formulations in accordance with the invention (Table V).

TABLE V

| Example | 18 | 19 | 20 | 21 |
|---|---|---|---|---|
| Dispersant | | | | |
| Cyclohexanol | 2 | 2 | 1.2 | 0.95 |
| Butyl Alcohol | 1.4 | 3 | 0.8 | 1.8 |
| Dodecylbenzene Sulfonic Acid | 2.2 | 1.5 | 2.4 | 1.55 |
| Oleic Acid | 0.37 | 0.25 | 0.3 | 0.25 |
| Monoethanolamine | 0.37 | 0.25 | 0.3 | 0.25 |
| Nonylphenol 5EO Condensate | 0.37 | 0.25 | 0.3 | 0.25 |
| Methyl Benzoate | 2.6 | 0 | 1.2 | 2.05 |
| Dimethyl phthalate | 2 | 0 | 0 | 1.52 |
| Methyl Salicylate | 0 | 0 | 0 | 1.2 |
| Mononuclear Swelling Agent: | | | | |
| Chlorotoluene | 89 | 93.2 | 93 | 90.2 |

EXAMPLES 22–25

Non-flammable dye assistant formulations have been prepared, using an undiluted dye assistant containing 92.6–90.8 chlorotoluene, and diluting it with 11–13% water in intimate solution.

As the amount of the surfactant is reduced from 1.91% to 1.67% the water that may be incorporated in the system is also reduced. When the surfactant is below 1.5% the water which can be added is reduced to below 10% and the liquid becomes partially flammable.

A dispersant formulation was prepared using 2.8 cyclohexanol, 4.0 parts butylalcohol, 2.5 parts dodecylbezene sulfonic acid, 0.5 parts oleic acid, 0.5 parts monoethonolamine, 0.5 parts nonylphenol 5EO condensate, and the following compositions are prepared:

TABLE VI

| Example | 22 | 23 | 24 | 25 |
|---|---|---|---|---|
| Mononuclear swelling agent | 92.61 | 92.01 | 91.11 | 90.81 |

TABLE VI-continued

| Example | 22 | 23 | 24 | 25 |
|---|---|---|---|---|
| chlorotoluene | | | | |
| Dispersant | 7.29 | 7.89 | 8.79 | 9.09 |
| These formulations contain an increasing percentage of the anionic surfactant dodecylbenzene sulfonic acid as follows: | | | | |
| anionic surfactant | 1.687 | 1.826 | 2.03 | 2.104 |

(%)

Ten gram samples were then titrated and the range of clarity was found to be as follows:

| Range of Clarity | 10 | 12 | 13 | 13 |
|---|---|---|---|---|
| Dispersion in Water | very good | excellent | excellent | excellent |

The samples diluted to the limit of the range of clarity were then tested for flammability. Examples 23–25 were found to be non-flammable while Example 22 was borderline.

I claim:

1. A textile dye assistant composition for use in the level dyeing of synthetic hydrophobic fibers and comprising:

(a) a non-phenolic, mononuclear, aromatic swelling agent for the fiber to be dyed and selected from the group consisting of toluene, xylene, trichlorobenzene, o-chlorotoluene and p-chlorotoluene; and (b) as a dispersant for the swelling agent, (i) at least one alcohol selected from the group consisting of cyclohexanol, methylcyclohexanol, benzyl alcohol, pentan-1-ol and 3-methyl-butan-1-ol;

(ii) at least one alcohol selected from the group consisting of n-butyl alcohol and isobutyl alcohol; and (iii) a surfactant selected from the group consisting of alkyl sulfonic acids, alkylarylsulfonic acids, nonionic surfactants, and fatty acid soaps;

the ratio of swelling agent (a) to dispersant (b) being 10:1 to 50:1 by weight; the ratio of alcohol (i) to alcohol (ii) being about 0.4:1 to 3:1; the amount of surfactant (iii) being that amount sufficient to form an emulsion and disperse a dye to be used in the dyeing of the synthetic hydrophobic fibers; and the dye assistant composition having a range of clarity, which is the total volume of water in terms of a percentage that can be added to a volume of the composition before the onset of cloudiness following the onset of clarity, which does not exceed 35%.

2. A composition according to claim 1, wherein said dispersant further comprises at least one ester swelling agent having a water solubility of less than 1.5% and selected from the group consisting of methyl salicylate, methyl benzoate, ethyl benzoate, dimethylphthalate and diethylphthalate.

3. A composition according to claim 1, wherein the ratio of swelling agent to dispersant is between about 14:1 and about 32:1.

4. A composition according to claim 1, wherein the alcohol (i) is cyclohexanol and the alcohol (ii) is n-butyl alcohol.

5. A composition according to claim 1, containing from 10% to 25% based on the weight of the swelling agent and dispersant, of water.

* * * * *